US010088135B2

(12) United States Patent
Petit et al.

(10) Patent No.: US 10,088,135 B2
(45) Date of Patent: Oct. 2, 2018

(54) MOUNTING BASE FOR WORK LIGHT

(71) Applicant: Akron Brass Company, Wooster, OH (US)

(72) Inventors: Kevin Petit, Wooster, OH (US); Peter Lauffenburger, Orrville, OH (US); Sean Tillinghast, Sunbury, OH (US)

(73) Assignee: Akron Brass Company, Wooster, OH (US)

( * ) Notice: Subject to any disclaimer, the term of this patent is extended or adjusted under 35 U.S.C. 154(b) by 23 days.

(21) Appl. No.: 15/156,935

(22) Filed: May 17, 2016

(65) Prior Publication Data

US 2016/0341405 A1 Nov. 24, 2016

Related U.S. Application Data

(60) Provisional application No. 62/164,910, filed on May 21, 2015.

(51) Int. Cl.

| | |
|---|---|
| ***F21V 21/088*** | (2006.01) |
| ***F21V 21/08*** | (2006.01) |
| *F21W 131/10* | (2006.01) |
| *F21V 21/40* | (2006.01) |

(52) U.S. Cl.

CPC ..... *F21V 21/08* (2013.01); *F21V 21/40* (2013.01); *F21W 2131/1005* (2013.01)

(58) Field of Classification Search

CPC ..... F21V 21/08; F21V 21/088; F21V 21/0885
USPC ..... 362/382, 396
See application file for complete search history.

(56) References Cited

U.S. PATENT DOCUMENTS

| | | | | |
|---|---|---|---|---|
| 5,448,463 | A * | 9/1995 | Leen | F21L 14/00 362/263 |
| 6,749,166 | B2 * | 6/2004 | Valentine | F16M 11/40 24/115 H |
| 2004/0032726 | A1 | 2/2004 | Lee | |
| 2005/0057935 | A1 | 3/2005 | Lee | |
| 2005/0243564 | A1 | 11/2005 | Stekelenburg | |

(Continued)

FOREIGN PATENT DOCUMENTS

| | | | |
|---|---|---|---|
| JP | 2008-027590 | A | 2/2008 |
| KR | 10-2013-0049073 | A | 5/2013 |

OTHER PUBLICATIONS

PCT International Search Report and Written Opinion from International Application No. PCT/US2016/032881, dated Aug. 24, 2016, 10 pages.

*Primary Examiner* — Evan Dzierzynski
*Assistant Examiner* — Keith G Delahoussaye
(74) *Attorney, Agent, or Firm* — Tucker Ellis LLP; Michael G. Craig; Heather M. Barnes

(57) ABSTRACT

One or more techniques and/or systems are disclosed for a light mounting base to which a light may be selectably coupled. The light mounting base can be selectably engaged with a target mounting surface, thereby allowing the light to be mounted thereto. The light mounting base can comprise one or more target mounting surface engaging components that can be used to selectably engage the base with the target mounting surface. The light mounting base may be configured to selectably mount on a door or panel. Further, the base may be configured to mechanically engage with a target mounting surface, such as a wall, thereby selectably fastening the light mounting base and attached light to the target mounting surface.

19 Claims, 18 Drawing Sheets

(56) References Cited

U.S. PATENT DOCUMENTS

2011/0222274 A1* 9/2011 Ko ..... F21L 4/00
362/191

* cited by examiner

MOUNTING BASE FOR WORK LIGHT

CROSS-REFERENCE TO RELATED APPLICATIONS

This application claims priority to U.S. Ser. No. 62/164,910, entitled MOUNTING BASE FOR WORK LIGHT, filed May 21, 2015.

BACKGROUND

Lights are used to illuminate areas that may not have a desired illumination level for an intended use, such as a work area. Scene lighting is often used to illuminate a work scene, or emergency response scene. Typically, work and/or scene lights are disposed on the ground, or mounted on mounts and/or stands so that the illumination may be directed to a desired target area. Mounts may comprise a system that allows the light to be selectably secured to the mount, and the mount can be secured to an object or placed on a horizontal surface, such as the floor. Further, lights may be mounted on stands, or the mount may be mounted on a stand, which is typically placed on the ground, and the stand may be adjusted to a desired height and/or direction.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

As provided herein, a light mounting base that may allow a lighting system (e.g., work light, scene light, etc.) to be selectably engaged with a target mounting surface, such as a substantially vertical surface. As an example, a work scene may comprise one or more doors, walls, or other objects comprising various surfaces, and the light mounting base can comprise components that allow for engagement with the target mounting surface. In this example, the light mounting base, and attached light, can be selectably coupled with the door, panel, wall or other object surfaces. In other implementations, the light mounting base can comprise a surface engaging component that can be used to selectably, mechanically engage with a target mounting surface, and selectably couple the light mounting base, and attached light, to the target mounting surface, allowing it to be selectably engaged with the target mounting surface.

In one implementation, a light mount can comprise a mount support component that extends between a first end and a second end of a light mount. The mount support can be configured to operably couple with a light holder base, and support at least a portion of the weight of a combination of the light holder base and an engaged work light. Further, the light mount can comprise a surface mounting component that is disposed at the second end. The surface mounting component can comprise a first protrusion that extends downward from the second end at a desired angle to the mount support component. The first protrusion can be configured to selectably engage with a portion of a target mounting surface, and operably dispose the light mount in a hanging disposition from the target mounting surface, when used in combination with the light holder base.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1:
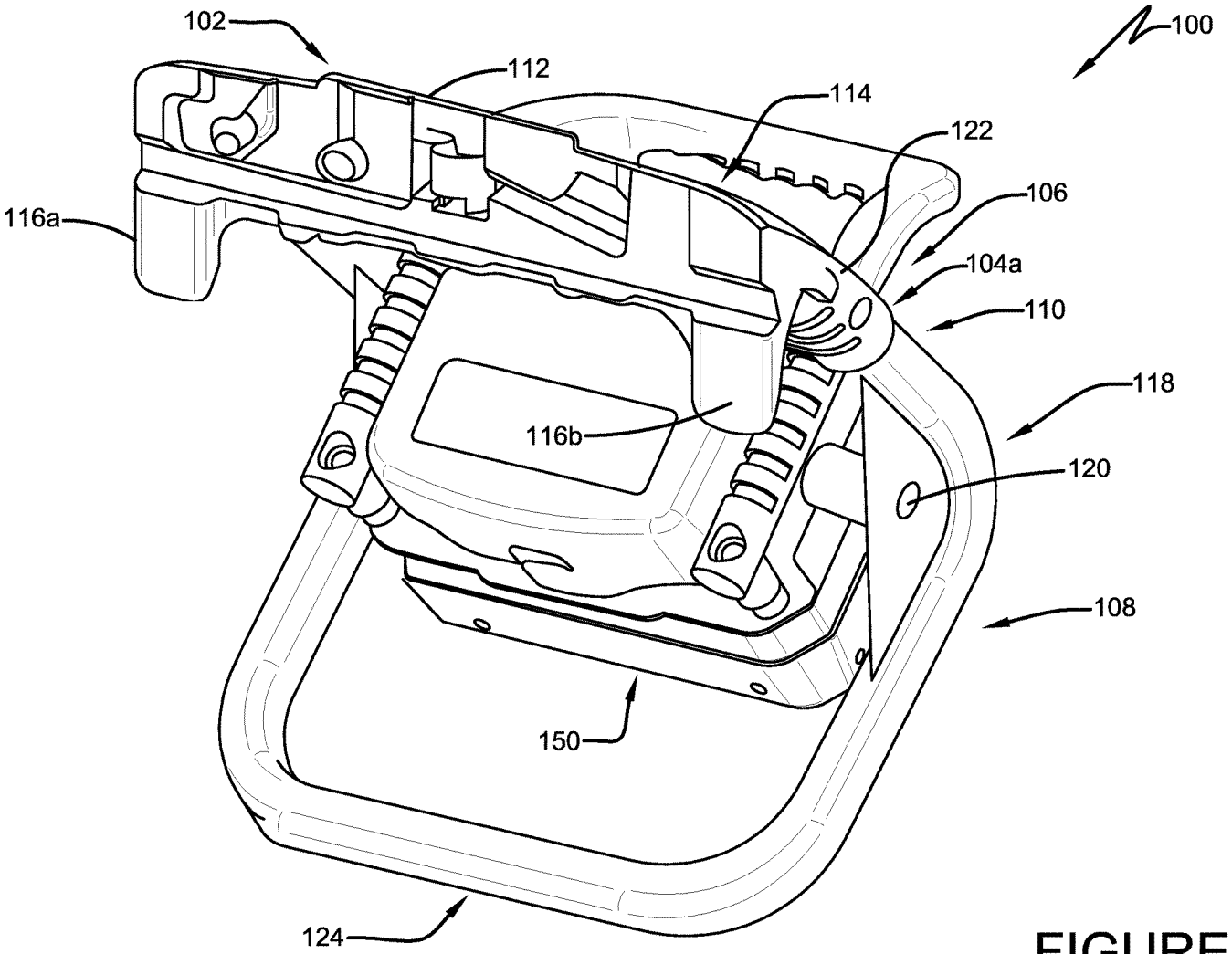
FIG. 1 is a component diagram illustrating a perspective view of an example implementation of an exemplary light mount.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices may be shown in block diagram form in order to facilitate describing the claimed subject matter.

A light mounting base may be devised that allows a lighting system to be selectably engaged with a target mounting surface, such as a substantially vertical surface, for example, for the purpose of holding the lighting system in place to provide directed illumination to a work scene. As an example, a work scene may comprise one or more doors, walls, other vertical panels (e.g., walls having a top that is not flush with a ceiling). In one implementation, the light mounting base can comprise vertical protrusions that may engage with (e.g., hang from the back of) the target mounting surface. In this example, the light mounting base can be selectably coupled with, and support, a work light, and the combination light mounting base and work light can be selectably hung from the door or other surface. In another implementation, the light mounting base can comprise a surface engaging component that is coupled with a base portion of the light mounting base. In this implementation, for example, the surface engaging component can be used to selectably, mechanically fasten to (e.g., puncture) a target mounting surface (e.g., drywall, masonry, wood, other materials), and engage the light mounting base with the target mounting surface. Further, in this example, the light mounting base can be coupled with, and support, the work light, and the combination light mounting base and work light can be selectably fastened to the target mounting surface.

FIGS. 1, 2, 3 and 4 are component diagrams illustrating an example implementation of an exemplary light mounting base 100. The exemplary light mounting base 100 comprises a surface mounting component 102 (e.g., a vertical surface mounting component). For example, the surface mounting component 102 can be configured to provide for selectably mounting a light 150 to a target mounting surface. As an example, a target mounting surface can comprise a wall, a partial wall, a door, or panel. In this example, the surface mounting component 102 can be used to mount the exemplary light mounting base 100 to a wall, partial wall, door, panel, an irregular surface or other object (e.g., found at a scene where lighting may be utilized). Further, for example, a light 150 can be coupled (e.g., selectably) to the exemplary light mounting base 100, such as using a fastener (e.g., threaded knobs, clips, pins, screws, etc.). In this way, for example, the light 150 mounted to the exemplary light mounting base 100 can be practicably mounted to the wall, partial wall, door, or panel and used to direct desired artificial illumination in a work area.

In this implementation, the surface mounting component 102 can comprise a coupler 104, such as a first coupler 104*a* and second coupler 104*b* (e.g., disposed in a coupling component, such as a first coupling component and/or a second coupling component) disposed at a first end 106 of the surface mounting component 102. The coupler 104 can be configured to couple the surface mounting component 102 with an angled portion 108 of the light mounting base 100. In one implementation, the coupler 104 can comprise a sleeve (e.g., a tubular configuration) configured to receive a complementary first end 110 of the angled portion 108 (e.g., or vice versa, the first end 110 of the angled portion 108 may comprise the sleeve). Further, a fastening means (e.g., a bolt, screw, clip, pin, or other suitable means) may be utilized to selectably secure the coupler 104 with the angled portion 108. It is anticipated that alternate coupling means may be utilized to engage the surface mounting component 102 with the angled portion 108, such as those suitably chosen by sound engineering principles. In one implementation, the complementary end 110 of the angled portion 108 can be configured to selectably engage with other mounting components, such as an elevating stand, pole, alternate floor mount, or other desired light mounting system. That is, for example, the angled portion 108 can be modular to fit with a plurality of different mounting systems.

Figure 2:
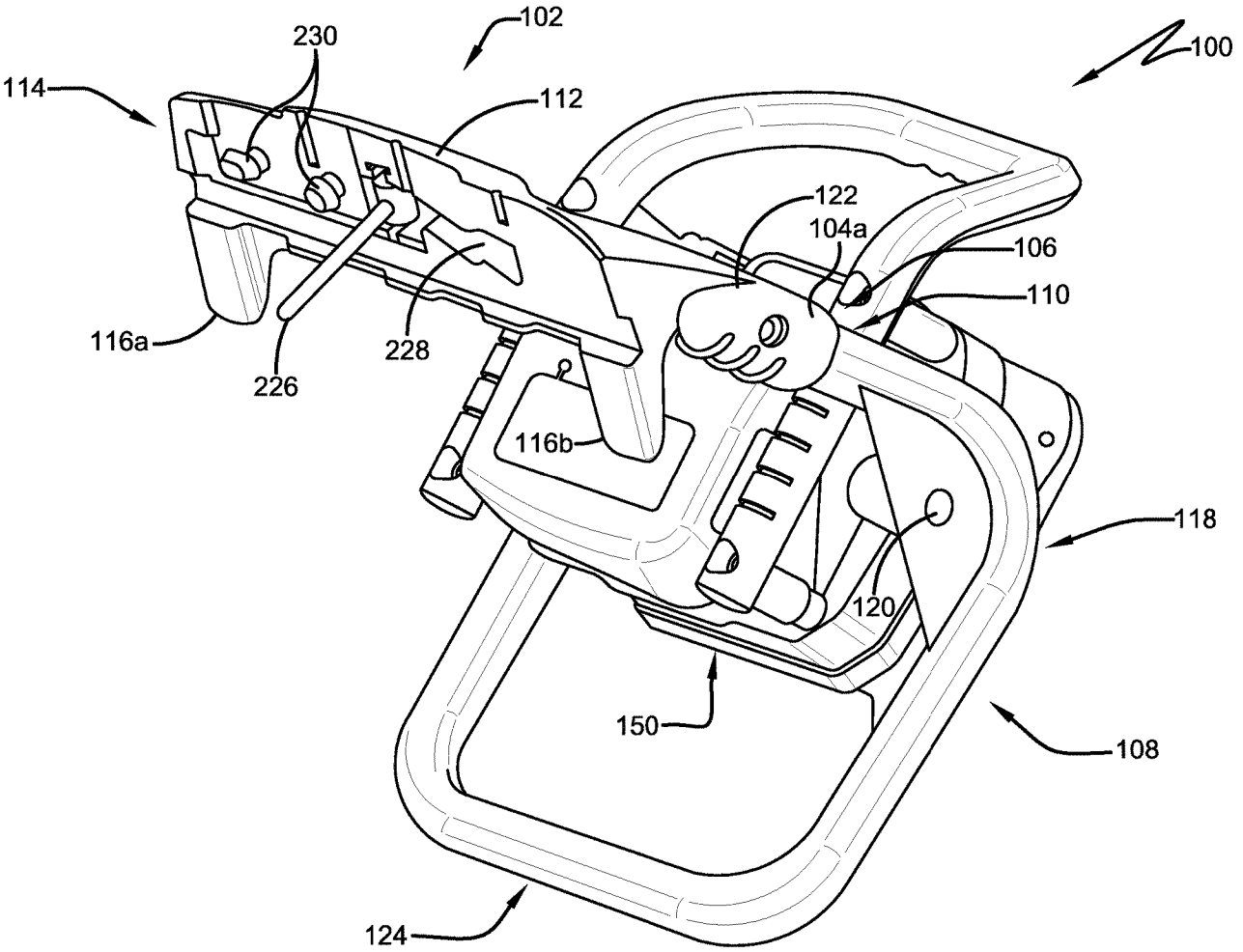
FIG. 2 is a component diagram illustrating a perspective view of an example implementation of an exemplary light mounting base.
Figure 3:
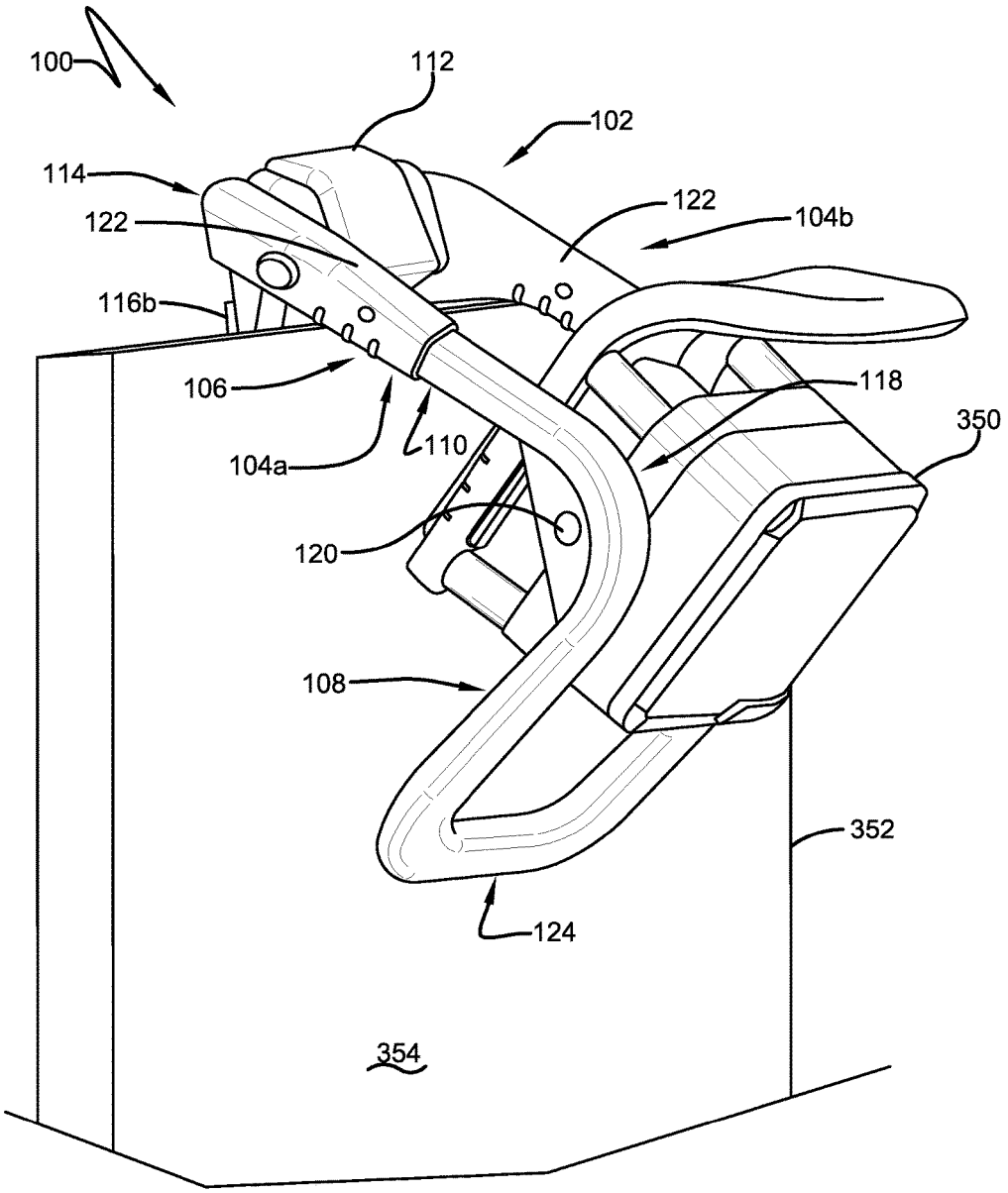
FIG. 3 is a component diagram illustrating a perspective view of an example implementation of one or more portions of one or more components described herein.
Figure 4:
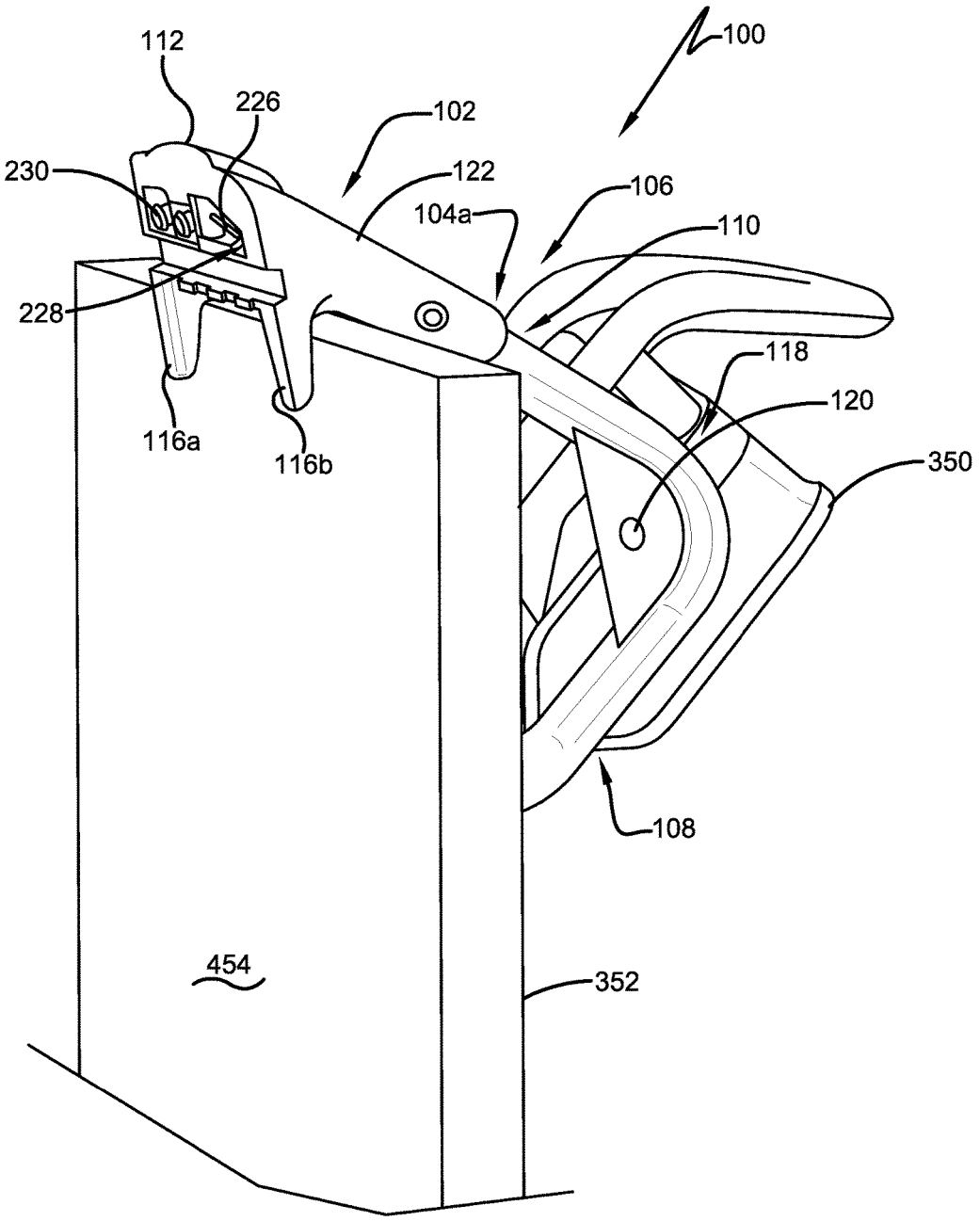
FIG. 4 is a component diagram illustrating a perspective view of an example implementation of one or more portions of one or more components described herein.
Figure 5:
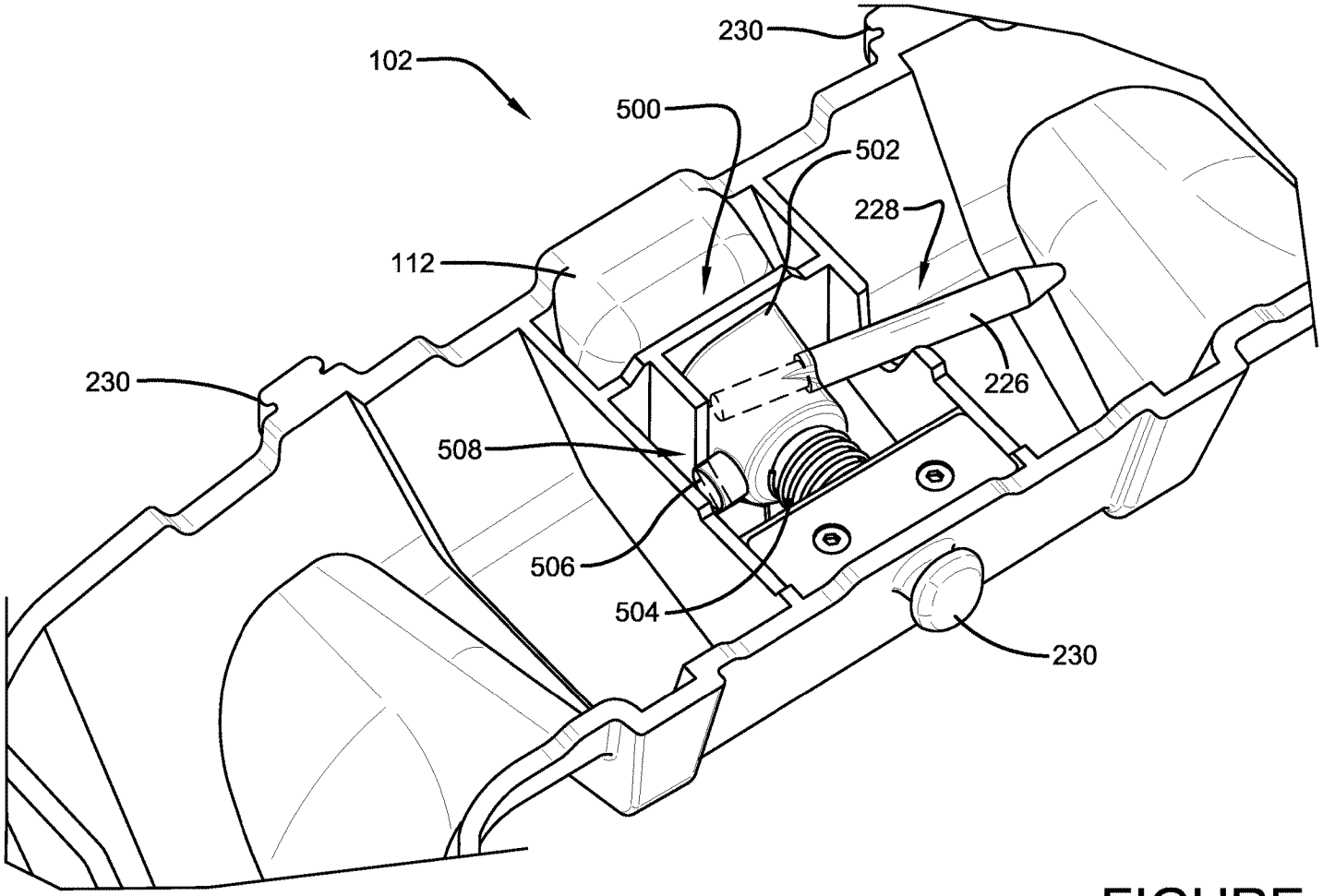
FIG. 5 is a component diagram illustrating a rear perspective, cut-away view of an example implementation of one or more portions of one or more components described herein.
Figure 6:
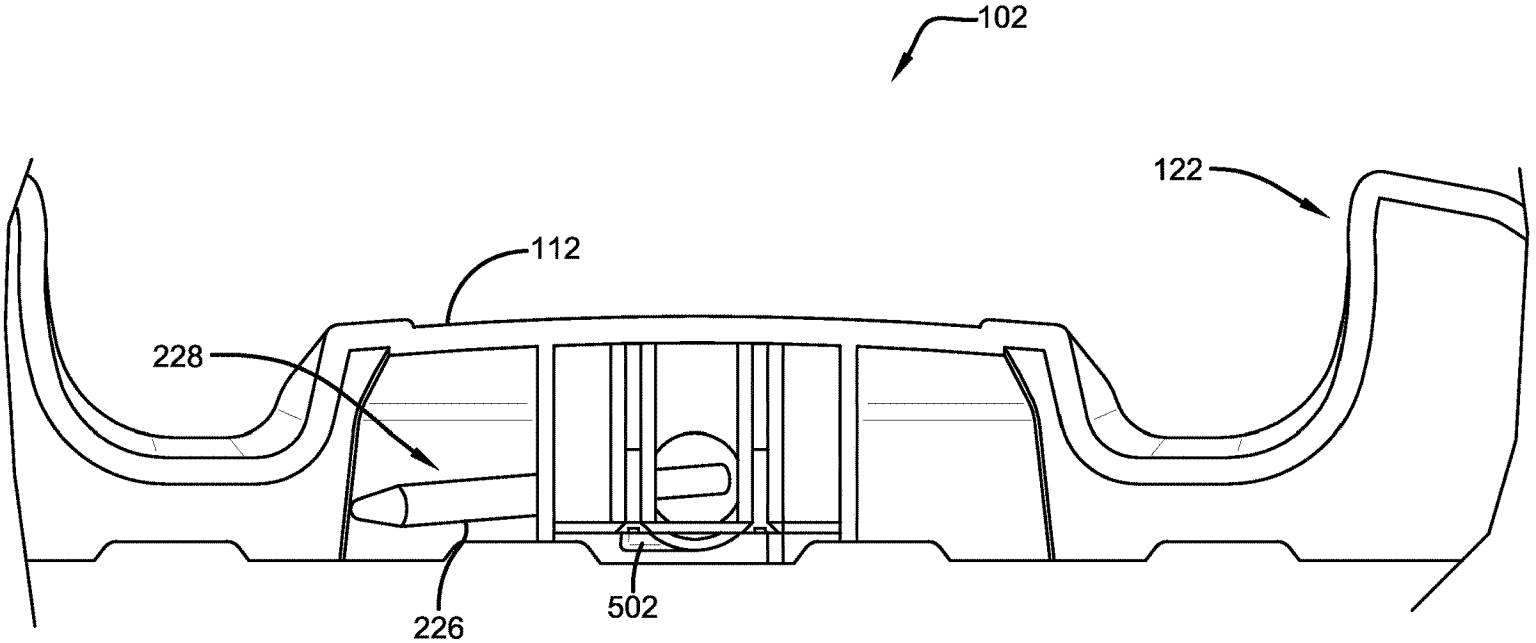
FIG. 6 is a component diagram illustrating a top, cut-away view of an example implementation of one or more portions of one or more components described herein.

As illustrated in FIGS. 1-4, the surface mounting component 102 can comprise a base portion 112 (e.g., a hanging component) disposed at a second end 114 of the surface mounting component 102. Further, the surface mounting component 102 can comprise at least one protrusion 116 extending from the base 112 at a desired angle (e.g., appropriate for the purpose of providing a mount, such as an acute angle) to a mount support arm 122 (e.g., a mount support component, such as a vertical mount support arm). One or more protrusions 116*a*, 116*b* (e.g., a first protrusion and a second protrusion) can be configured to engage a target mounting surface, such as a substantially vertical surface. As an illustrative example, as illustrated in FIGS. 3 and 4, the surface mounting component 102 of the light mounting base 100 can be mounted on a target mounting surface 352, such as a door, wall, partial wall, panel, divider, partition, or other similar surface. In this example, the one or more protrusions 116*a*, 116*b* can selectably engage with a second side 454 (e.g., the back side) of the target mounting surface 352, thereby allowing the light mounting base 100 to hang from the target mounting surface 352.

As illustrated in FIGS. 1 and 2, with continued reference to the illustrative examples in FIGS. 3 and 4, in one implementation, the surface mounting component 102 can comprise a surface fastening component 226, such as a support pin, that is operably engaged with the base portion 112. The surface fastening component 226 can be configured to be selectably disposed between a mounting position (e.g., in FIG. 2) and a stowed position (e.g., in FIGS. 1 and 4). Further, the surface fastening component 226 can be configured to selectably engage with a target mounting surface by means of mechanically and selectably engaging with the target mounting surface when disposed in the mounting position, such as by being driven into the target mounting surface. In one implementation, the surface fastening component 226 can be stowed in a pin stowage 228 portion of the base 112, for example, to mitigate potential catching or intrusion of the pin 226 on other surfaces or objects.

In one example, the surface fastening component 226 as a support pin can be disposed in the mounting position (e.g., FIG. 2, moved from stowage 228) and driven into a target mounting surface (e.g., wall, etc.) to facilitate mounting the light mounting base 100 on the target mounting surface. For example, the surface fastening component 226 can be pushed or hammered into a drywall surface, a wooden or masonry surface, or otherwise driven into a target mounting surface. In one implementation, the support pin can be driven into the target mounting surface at least until the rear face of the base portion 112 engages the target mounting surface. In this implementation, for example, the rear face of the one or more protrusions 116*a*, 116*b* may also engage with, and disposed parallel to, the target mounting surface, thereby providing additional support. In one implementation, the surface fastening component 226 can comprise a course surface, for example, comprising ridges, threads, dimples, bumps, or an otherwise non-smooth surface. In this implementation, the course surface may facilitate mechanical fastening of the surface fastening component 226 in the target mounting surface material by providing an increase in friction between the surface of the surface fastening component 226 and the target mounting surface material.

As illustrated in FIGS. 1, 2, and 4, the surface mounting component 102 can comprise one or more base anchor points 230. In one implementation, the base anchor points 230 can be disposed on the base portion 112 and configured to provide an attachment point on the base portion 112 for an alternate way of fastening the mount to a vertical (e.g., or other) surface or structure, such as a horizontal surface, pole, stand, irregularly shaped object. That is, for example, a strap, cord, bungee, elastic band, rope, wire, or other suitable fastening means may be attached to at least one of the base anchor points 230 and used to mount the light mounting base 100 to a desired location (e.g., wrapped around a frame member, support, pipe, or any suitable object). As another example, an elastomeric (e.g., rubber-like) band or strap may be attached to a first anchor point 230 and wrapped over or around a frame member and attached to a second anchor point 230 to mount the light mounting base 100 to the frame member. In an alternate implementation, the surface mounting component 102 can comprise an alternate coupling means, for coupling the light mounting base 100 to a desired alternate mount, such as a pole, stand, alternate surface or object. For example, the surface mounting component 102 can comprise a coupler that mounts to a stand, such as a threaded portion or complementary coupling component.

With continued reference to FIGS. 1-4, light mounting system, comprising the exemplary light mounting base 100, can comprise an angled portion 108. In one implementation, the angled portion 108 can be configured to form a type of A-frame base when coupled with the surface mounting component 102. In this implementation, for example, the light mounting base 100 coupled with the angled portion 108 may be placed on a horizontal surface, and can provide support for a light mounted to the light mounting base 100. Further, the A-frame type shape of the combined light mounting system, for example, may provide suitable support when the light mounting base 100 is hung from, or secured to, a target mounting surface. In one implementation, the angled portion 108 can comprise a tubular construction, for example, comprising one or more sections of tubing (e.g., metal, plastic, polymer, wood, etc.) that can be bent or shaped to form the desired shape. In another implementation, the angled portion 108 can comprise a solid construction (e.g., or combination of solid and tubular), comprising one or more sections that are bent, shaped, and/or arranged (e.g., joined) to form the desired shape.

In one implementation, the angled portion 108 can comprise a first end 110 configured to couple with the surface mounting component 102. In one implementation, the first end 110 of the angled portion 108 may be configured to slidably engage with the coupler 104 of the surface mounting component 102. For example, the coupler 104 may comprise a sleeve (e.g., or portion thereof) that is configured to receive the first end 110, or the first end 110 may comprise a sleeve configured to receive the coupler 104*a*, 104*b*. In one implementation, the first end 110 may comprise merely one engagement portion configured to couple with merely one coupler 104*a* of the surface mounting component 102. In another implementation, as illustrated in FIG. 3, the first end 110 may comprise a plurality (e.g., two) engagement portions (e.g., a first portion and a second portion) that are configured to respectively couple with a corresponding coupler 104*a*, 104*b* (e.g., a first coupler and a second coupler) of the surface mounting component 102.

In one implementation, the angled portion 108 can comprise a second end 124 (e.g., support end) that is configured to engage with the target mounting surface (e.g., at the first side) when at least the one of the one or more protrusions 116*a*, 116*b* and/or the surface fastening component 226 (e.g., pin) is engaged with the target mounting surface. As an illustrative example, in FIGS. 3 and 4, the light mounting base 100 can be hung from a target mounting surface (e.g., panel, door, wall). In this example, the protrusions 116*a*, 116*b*, extending downward from the base portion 112 of the surface mounting component 102, engage with the second side 454 of the target mounting surface 352; and the second (support) end 124 of the angled portion 108 engages with the first side 354 of the target mounting surface 352. In this way, for example, a force is applied to the second side 454 by the protrusion(s) 116*a*, 116*b*, while a force is applied to the first side 354 by the second (support) end 124 of the angled portion 108. In this example, this configuration may allow the light mounting base 100 to be disposed in a hanging position from the target mounting surface. Further, in one implementation, the protrusion(s) 116*a*, 116*b* and second (support) end 124 may provide support footing for the light mounting base 100 when it is placed on a horizontal surface.

In one implementation, the angled portion 108 can comprise a light mount portion 120 (e.g., light coupler) disposed adjacent to a central angled portion 118, and the light mount portion 120 can be configured to selectably engage with a work light 150, 350. In one implementation, the light mount portion 120 can comprise a coupling means that provides for the light 150, 350 to be selectably coupled with the angled portion 108. For example, the coupling means can comprise a mechanical component that is configured to receive a complementary mechanical component disposed on the light 150, 350. As an example, the mechanical components may comprise a fastener configured to engage a through hole in the light mount portion 120, and a receiving hole in the light (e.g., such as a threaded coupler, pin, rod, specialized clip, etc.). As another example, the light may comprise a type of rod or pin that is configured to couple with a receiving hold in the light mount portion 120. It is anticipated that various and alternate coupling means may be employed by those skilled in the art; and the implementation described herein are not limited to any particular coupling means.

In one implementation, the surface mounting component 102 may be integral, or fixedly engaged, with the angled portion 108 of the light mounting base 100. For example, the angled portion 108, comprises the second end 124 and the light mount portion 120 that is adjacent to a central angled portion 118. In this example, the angled portion may be integral with the surface mounting component 102, which comprises the base portion 112 with the at least one protrusion 116. As an example, the surface mounting component 102 and the angled portion 108 may be formed integrally, or may be fixed together (e.g., welded, etc.). That is, it is anticipated that the light mounting base 100 may comprise a one piece frame (e.g., including the surface mounting component 102 and the angled portion 108), or a two or more piece frame.

In one aspect, the surface fastening component 226 can be moved between a stowed position and a mounting position. FIGS. 5-18 are component diagrams illustrating various aspects of one or more portions of one or more systems described herein. In one implementation, the surface mounting component 102 can comprise an adjustment component 500. The adjustment component 500 can comprise a pin holder 502, a biasing component 504, a stowage securing knob 506 and a stowage securing catch 508 (e.g., shown in FIGS. 5-14). Further, as illustrated in FIGS. 11-14, in one implementation, the adjustment component 500 can comprise a pin holder shaft 1102, comprising a tail 1104 and a head 1106.

Figure 8:
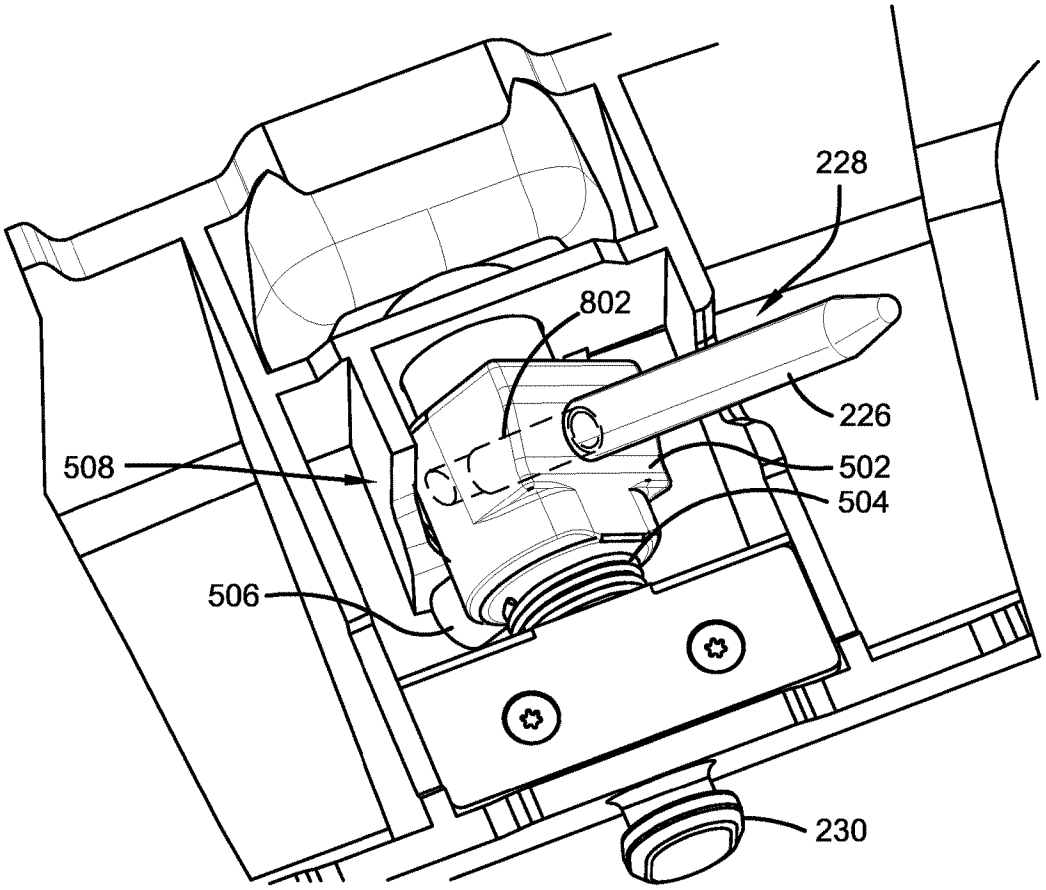
FIG. 8 is a component diagram illustrating a rear perspective, cut-away view of an example implementation of one or more portions of one or more components described herein.
Figure 13:
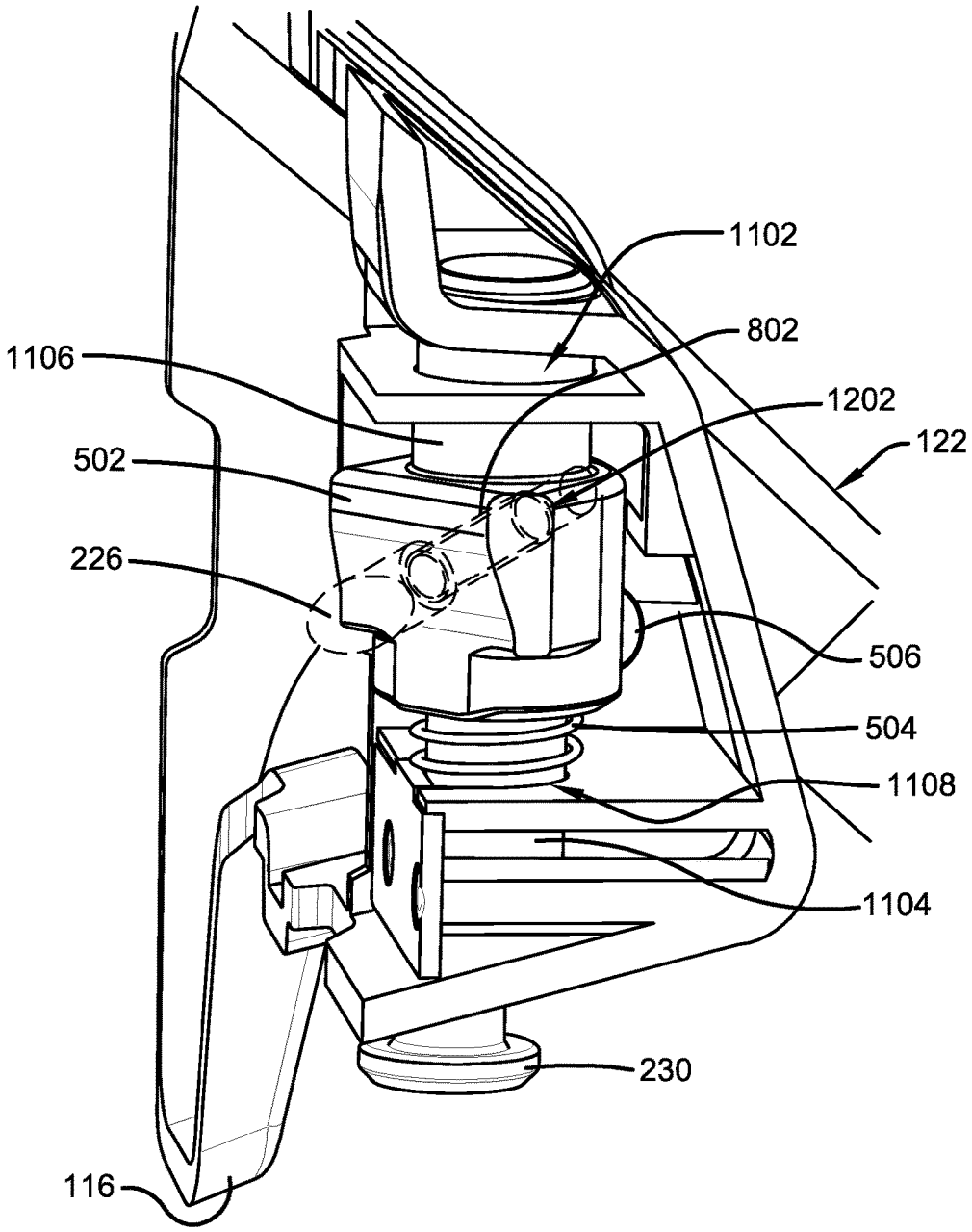
FIG. 13 is a component diagram illustrating a side perspective, cut-away view of an example implementation of one or more portions of one or more components described herein.
Figure 14:
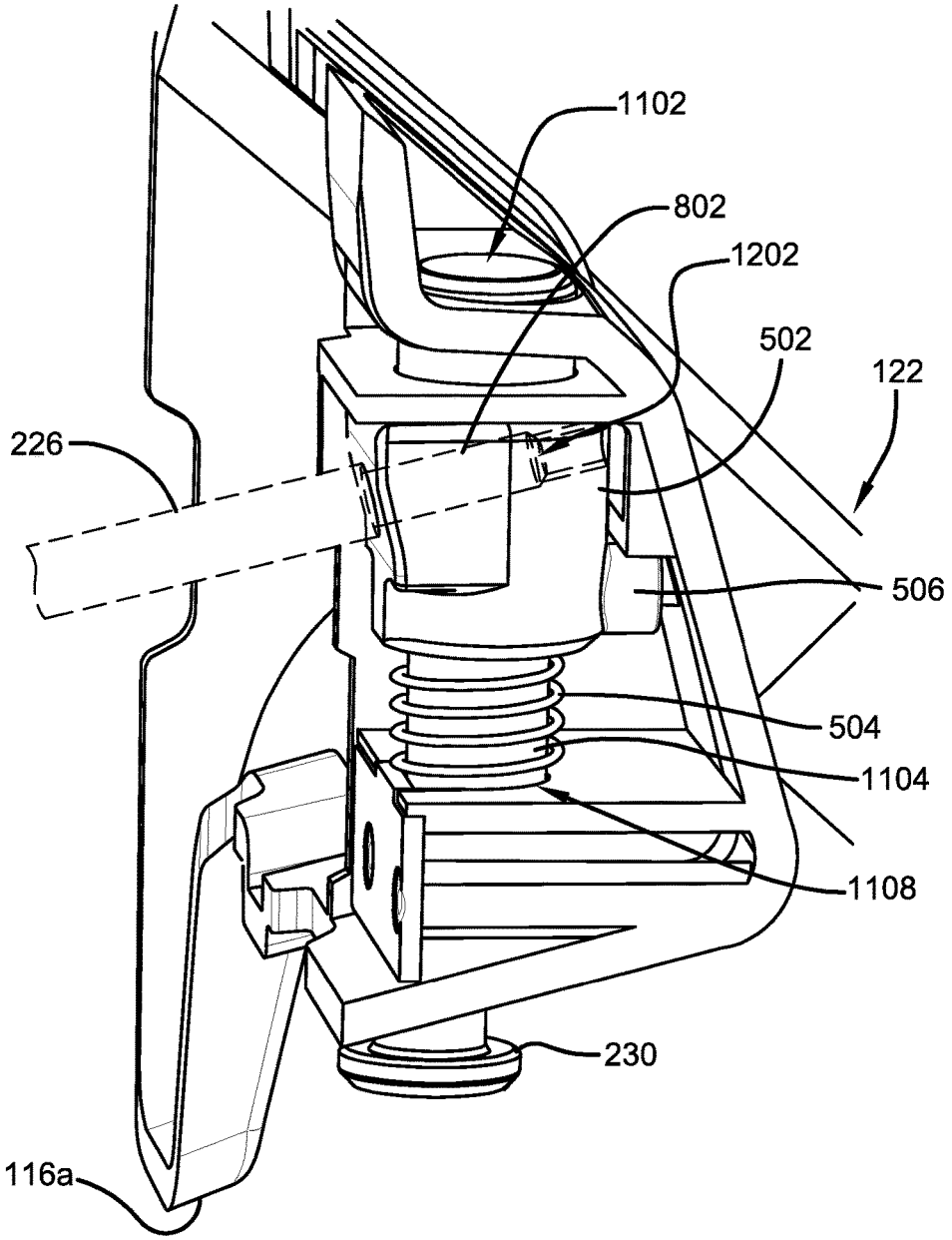
FIG. 14 is a component diagram illustrating a side perspective, cut-away view of an example implementation of one or more portions of one or more components described herein.

In one implementation, the pin holder 502 can be configured to receive a surface fastening component 226 (e.g., pin), and hold it in a secure manner. For example, the surface fastening component 226 may be configured to be selectably fastened to the pin holder 502, such as by a threaded fastening means. That is, for example, a proximal end 1202 of the pin may comprise a threaded portion (e.g., comprising male threads) and the pin holder 502 may comprise an internal threaded portion disposed in a receiver 802 (e.g., comprising female threads), as shown in FIGS. 8, 13 and 14. In this implementation, the threaded proximal end 1202 of the pin may be threadedly engaged with the threaded portion disposed in the receiver 802 of the pin holder 502. In one implementation, the pin 226 may be disposed in engagement with the pin holder 502 to provide a desired downward angle for the pin 226 when it is disposed in the mounting position, as illustrated in FIG. 14. As an example, the pin 226 may be straight, and the receiver 802 in the pin holder 502 may be disposed at an angle from a central axis to provide the downward pin angle when the pin 226 is engaged with the holder 502.

The adjustment component 500 can comprise the biasing component 504, such as a spring, which can be configured to bias the pin holder 502, and therefore the pin 226, in a desired direction. In the example implementation of FIGS. 5-14, the biasing component 504 is disposed on the tail portion 1104 of the pin holder shaft 1102. Further, the pin holder 502 may be biased against the head portion 1106 of the pin holder shaft 1102. That is, for example, the pin holder shaft 1102 can be coupled with the pin holder 502 by sliding the pin holder 502 onto the tail portion 1104 of the pin holder shaft 1102, through a hole in the pin holder 502 disposed though a central axis of rotation. Additionally, the tail portion 1104 of the pin holder shaft 1102 may be rotationally disposed in a shaft receiving hole 1108, and provide a means for allowing the pin holder shaft 1102 to rotate substantially freely around its central axis of rotation.

The adjustment component 500 can comprise a stowage securing catch 508, as illustrated in FIGS. 5 and 7-12. The stowage securing catch 508 can be configured to selectably engage with the stowage securing knob 506 disposed on the pin holder 502. As an example, the stowage securing catch 508 may be disposed at a position that is lower than a position of the stowage securing knob 506 when the pin holder 502 is disposed in its extended position provided by the biasing component 504. In this example, when a downward force, sufficient to overcome the biasing force, is applied to the pin holder shaft 1102 (e.g., at the head 1106, such as by a user) the pin holder 502 and pin 226 can be rotated and engaged with the stowage securing catch 508. Further, because the stowage securing catch 508 is disposed lower than the than a position of the stowage securing knob 506 when disposed in its extended position, the biasing component 504 can provide a biasing force to selectably hold the stowage securing knob 506 against the stowage securing catch 508. In this way, the pin holder 502 and pin 226 may be selectably disposed in the stowage position in the stowage area 228 of the base 112.

Figure 7:
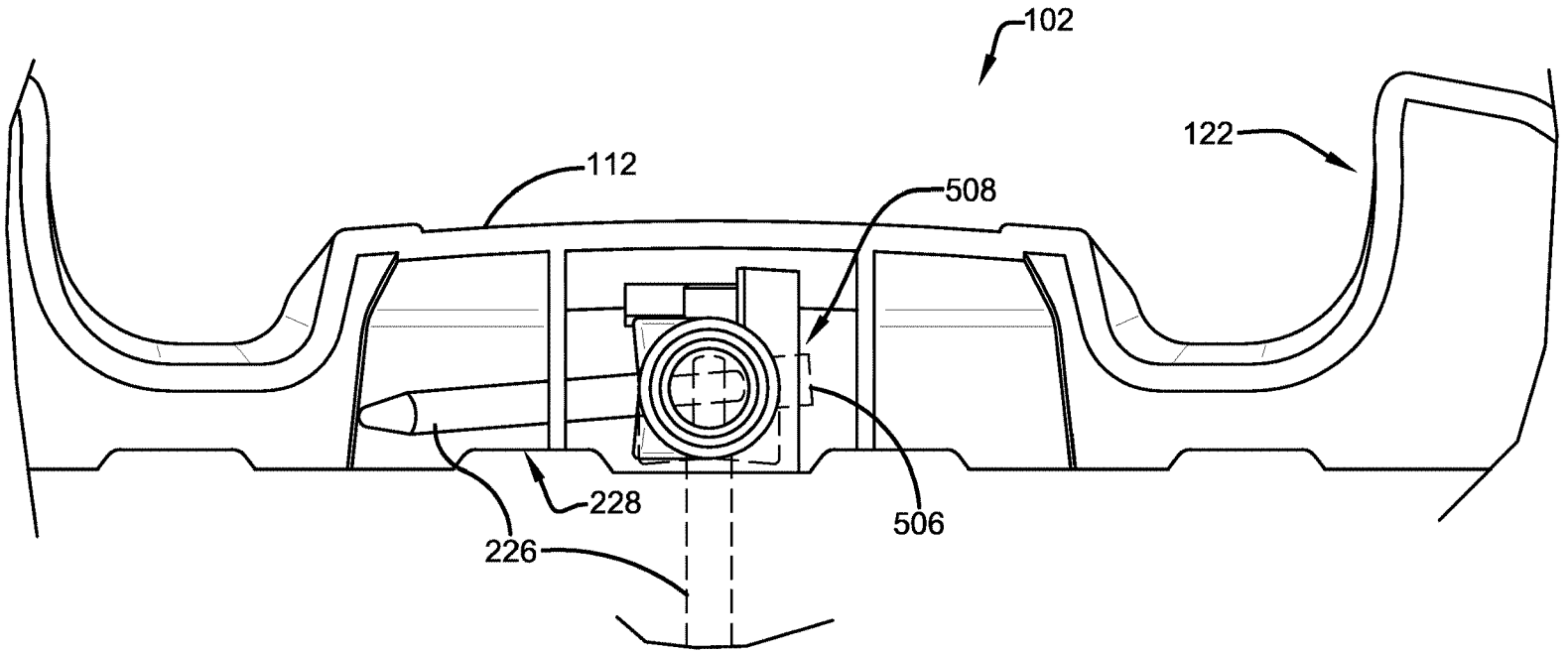
FIG. 7 is a component diagram illustrating a top, cut-away view of an example implementation of one or more portions of one or more components described herein.
Figure 9:
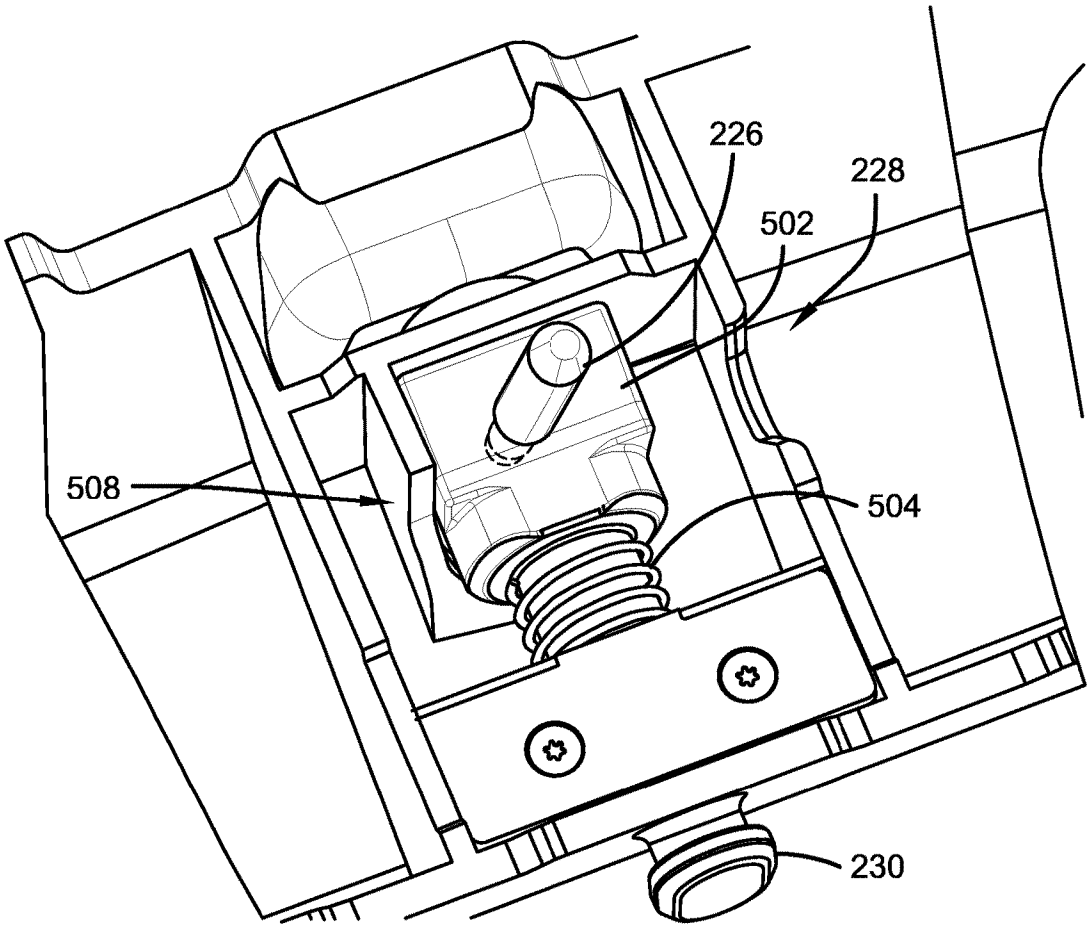
FIG. 9 is a component diagram illustrating a rear perspective, cut-away view of an example implementation of one or more portions of one or more components described herein.
Figure 10:
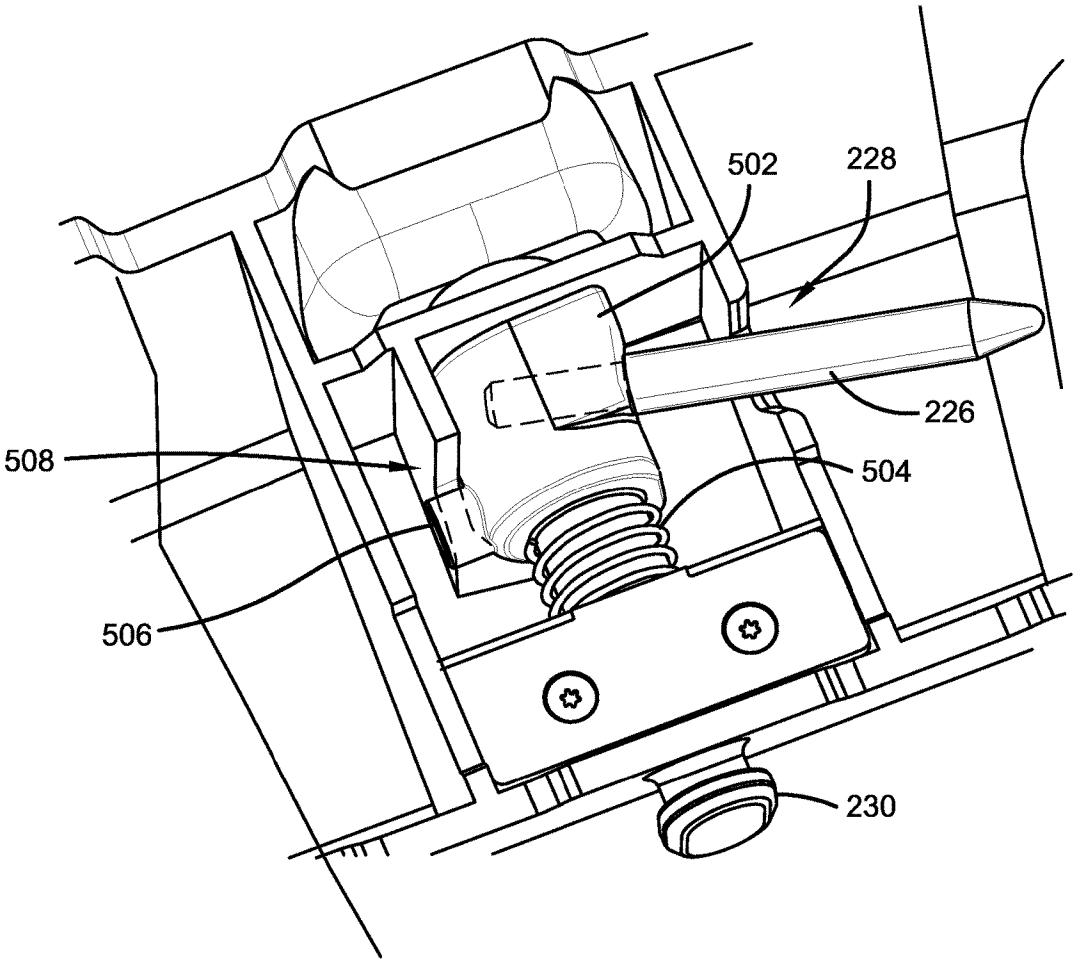
FIG. 10 is a component diagram illustrating a rear perspective, cut-away view of an example implementation of one or more portions of one or more components described herein.

As an illustrative example, FIGS. 5, 6, 10, 11, and 12 show the pin 226 and pin holder 502 disposed in the stowed position. FIG. 7 shows them in both the stowed and mounting position. In this example, the pin is selectively placed in the stowage area 228 of the base 112 and the stowage securing knob 506 is engaged with the stowage securing catch 508 by the biasing component 504. Further, as an illustrative example, FIGS. 7, 9, and 14 show the pin 226 and pin holder 502 disposed in the mounting (e.g., or partially, as in FIGS. 8 and 13) position. In this example, the stowage securing knob 506 has been disengaged from the stowage securing catch 508, such as by applying a downward force to the pin holder shaft 1102, and the pin holder 502 and pin 226 are biased up toward the top of the base 112.

Figure 15:
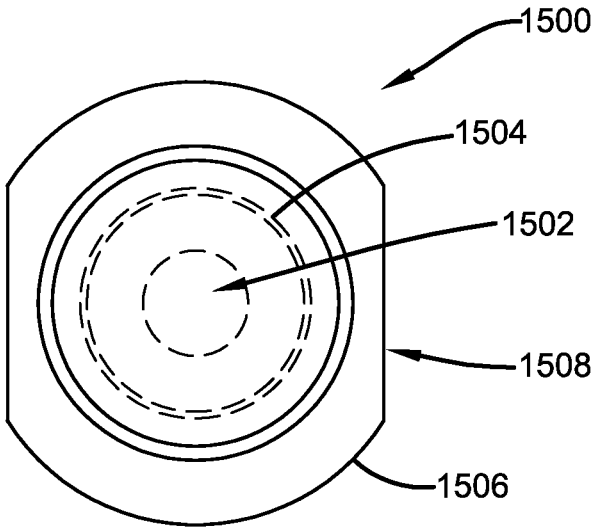
FIG. 15 is a component diagram illustrating a top view of an example implementation of one or more portions of one or more components described herein.
Figure 16:
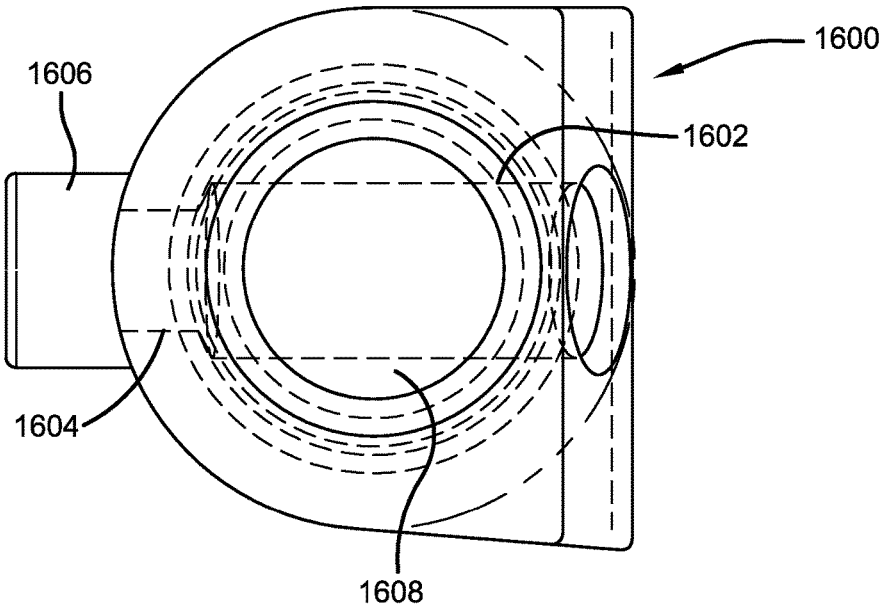
FIG. 16 is a component diagram illustrating a top view of an example implementation of one or more portions of one or more components described herein.
Figure 17:
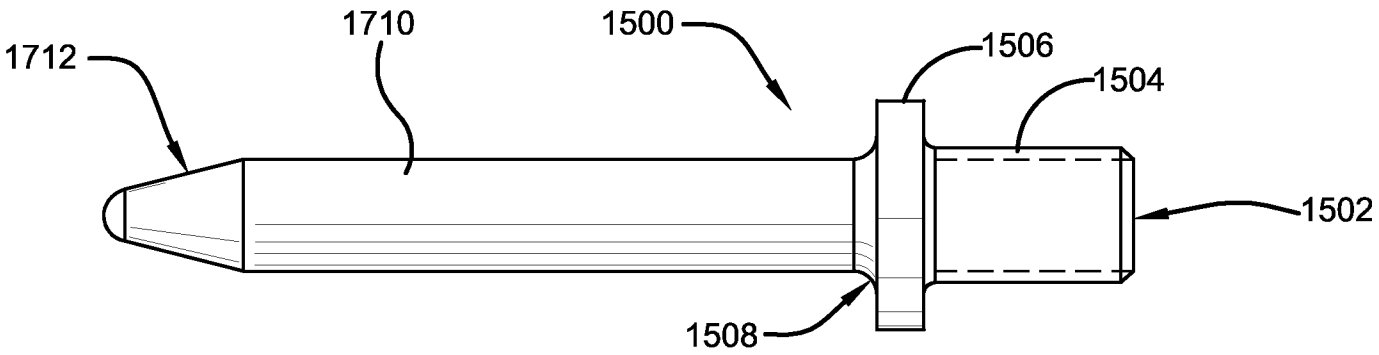
FIG. 17 is a component diagram illustrating a side view of an example implementation of one or more portions of one or more components described herein.

FIGS. 15-18 are component diagrams of example implementations of one or more portions of an adjustment system (e.g., 500), including a pin 1500, a pin holder 1600, and a pin holder shaft 1800. FIGS. 15 and 17 illustrate an example support pin 1500 (e.g., a vertical support pin). In this example implementation, the support pin 1500 can comprise a proximal end 1502, a threaded portion 1504, a collar 1506, a collar cut-out 1508, a pin shaft 1710, and a distal end 1712. Further, in this implementation, the threaded portion 1504 can be disposed at the proximal end 1502, and can be configured to threadedly engage with a complementary threaded portion of the pin holder 1600. In this way, for example, the support pin 1500 may be selectably replaceable with a new pin, such as when a pin becomes damaged. The collar 1506 may be configured to provide a mechanical stop for the engagement with the pin holder 1600, and can comprise the collar cut-out 1508. In one implementation, the collar cut-out 1508 can be configured to provide a means for engaging a tool with the pin 1500, such as for threadedly engaging the pin 1500 with the pin holder 1600. Additionally, the pin 1500 can comprise the pin shaft 1710 ending in the distal end 1712 of the pin 1500. In one implementation, the distal end 1712 can comprise a tapered area that is configured to provide a puncturing means, such as to facilitate driving the pin 1500 into a target mounting surface.

Figure 18:
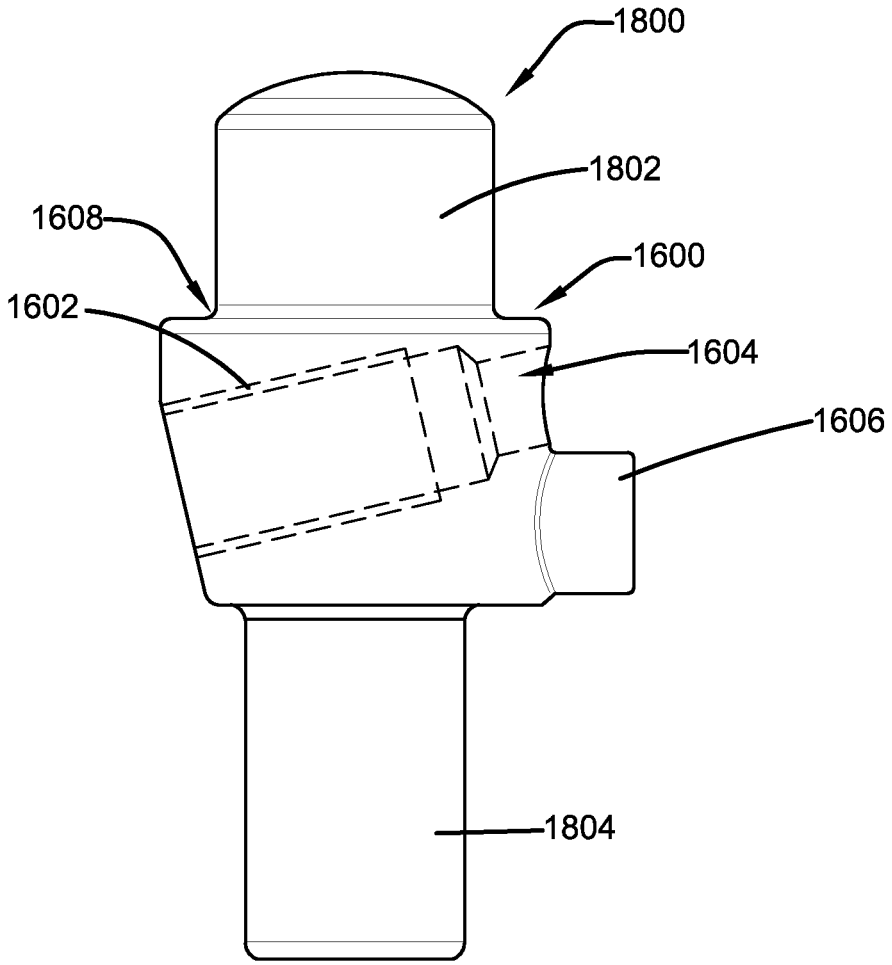
FIG. 18 is a component diagram illustrating a side view of an example implementation of one or more portions of one or more components described herein.

FIGS. 16 and 18 illustrate an example pin holder 1600 and pin holder shaft 1800. In this example, the pin holder 1600 can comprise a threaded pin receiver 1602, that is configured to threadedly receive the threaded portion 1504 of the pin 1500. Further, the pin holder 1600 can comprise a secondary receiver portion 1604, which may be configured to receive a differently sized pin. Additionally, the pin holder 1600 can comprise a stowage securing knob (e.g., 506 of FIG. 5), which can be configured to selectably engage with a stowage securing catch (e.g., 508 of FIG. 5). A pin holder shaft tube 1608 can be disposed along a central, rotational axis of the pin holder, and can be configured to receive the pin holder shaft 1800. In one implementation, the pin holder shaft 1800 may be configured to be slidably engaged with the pin holder shaft tube 1608, for example, such that the pin holder 1600 may effectively slide along the shaft 1800 during operation. In another implementation, the pin holder shaft may be fixedly engaged with the pin holder shaft tube 1608, such that the pin holder 1600 remains in a same position during operation.

Figure 11:
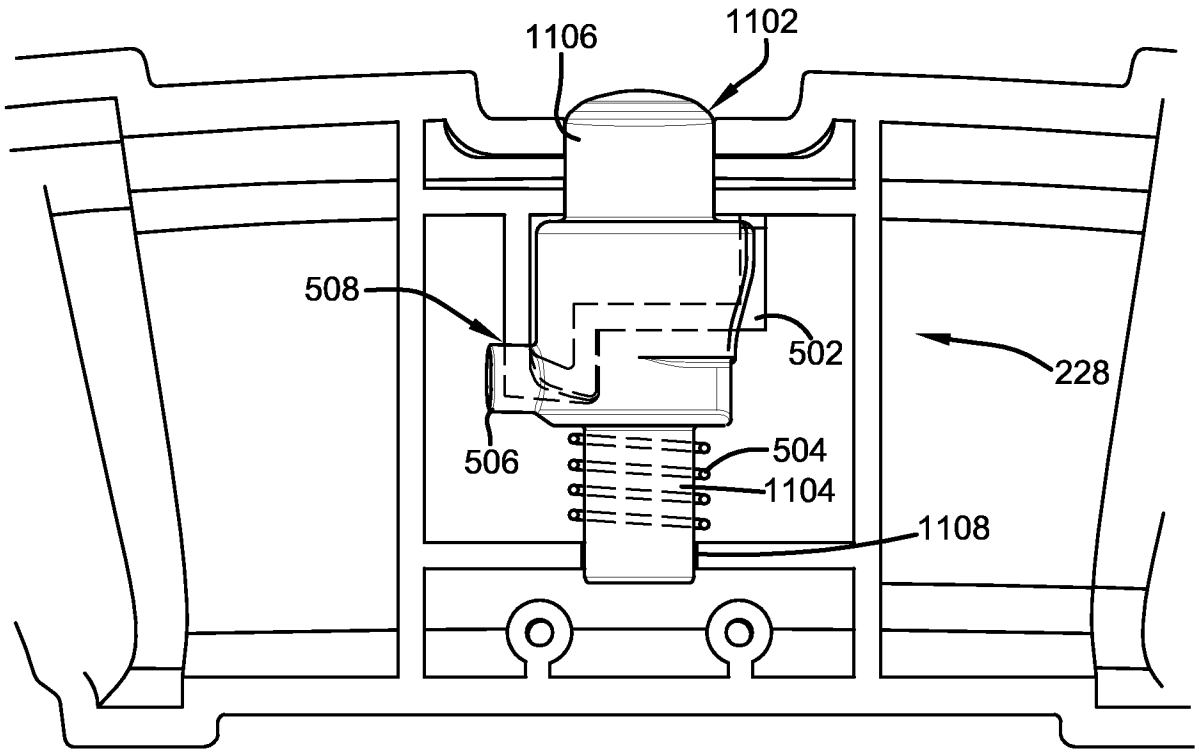
FIG. 11 is a component diagram illustrating a front, cut-away view of an example implementation of one or more portions of one or more components described herein.
Figure 12:
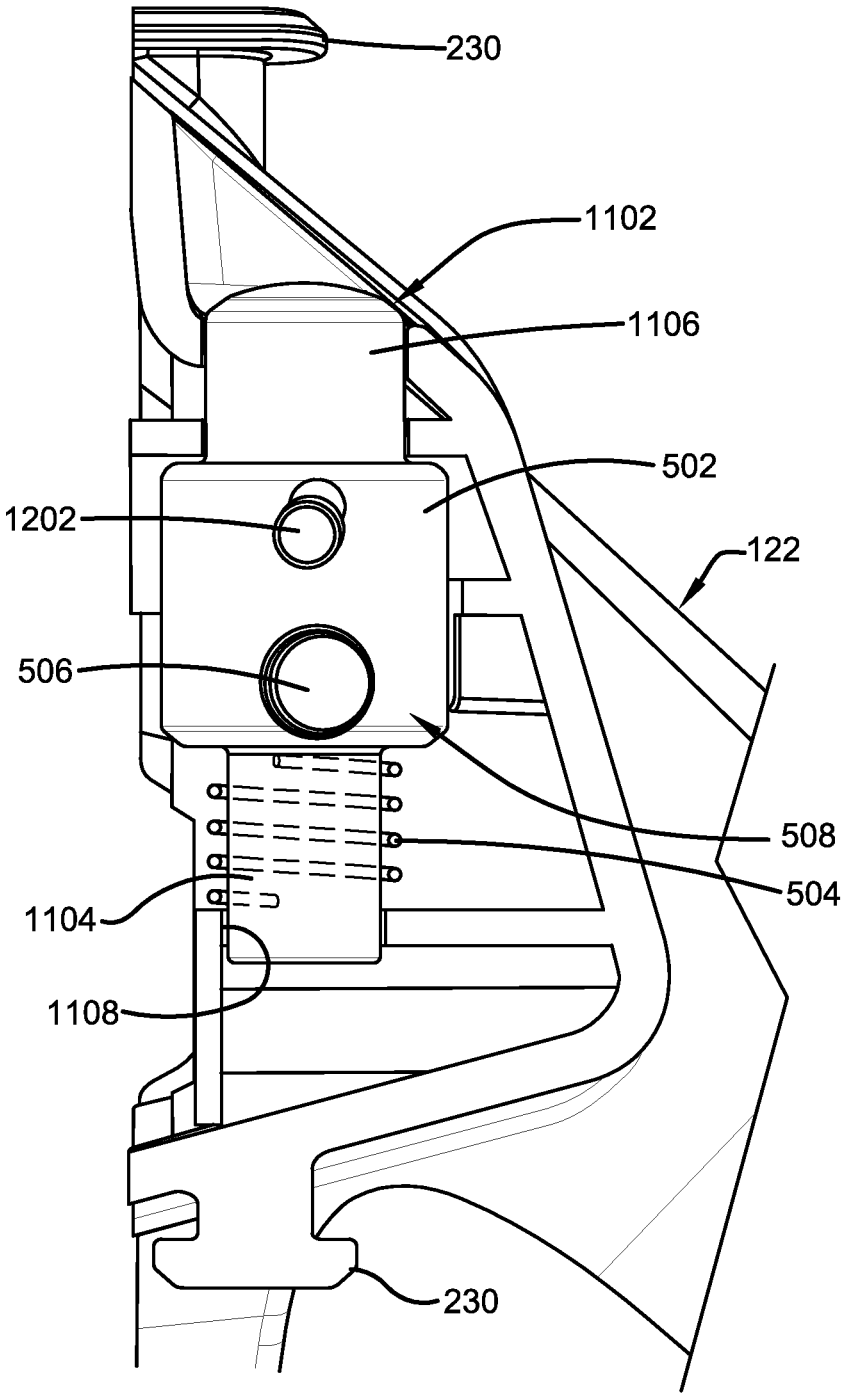
FIG. 12 is a component diagram illustrating a side, cut-away view of an example implementation of one or more portions of one or more components described herein.

The pin holder shaft 1800 can comprise a top portion 1802 (e.g., shaft head 1106 of FIG. 11), and a bottom portion 1804 (e.g., shaft tail 1104 of FIG. 11). In one implementation, the pin holder shaft tube 1608 may be configured to merely slidably engage with the bottom portion 1804, and the top portion 1802 can provide a mechanical stop for the pin holder 1600 on the shaft 1800. That is, for example, the biasing component 504 may bias the pin holder 1600 toward the shaft top portion 1802, and the pin holder 1600 may be stopped from sliding further up the shaft 1800 by the shaft top portion 1802.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. A surface mount for a light mount, comprising:

a mount support arm extending between a first end and a second end of the surface mount, and configured to operably couple, at the first end, with a light mounting base and to support at least a portion of the weight of a combination of the light mounting base with an engaged work light; and a base portion disposed at the second end of the mount support arm, and having a first protrusion extending downward from the base portion at the second end at a desired angle to the mount support arm, the first protrusion configured to selectably engage with a portion of a target mounting surface, and operably dispose the surface mount in a hanging disposition from the target mounting surface when used in combination with the light mounting base, wherein the desired angle between the first protrusion extending downward from the base portion at the second end and the mount support arm comprises an acute angle, which results in disposition of the mount support arm at a downward angle relative to the target mounting surface in operation.

2. The mount of claim 1, wherein the surface mount is further configured to engage with a second side of the target mounting surface, and provide support to the combination of the surface mount, light mounting base, and the work light when the light mounting base is engaged with a first side of the target mounting surface, wherein the first side and the second side comprising opposing sides of the target mounting surface.

3. The mount of claim 1, further comprising a coupling component disposed at the first end of the mount support arm and configured to selectably couple with the light mounting base, wherein the coupling component includes a first coupler configured to selectably engage with a first portion of the light mounting base, and a second coupler configured to selectably engage with a second portion of the light mounting base.

4. The mount of claim 1, further comprising a second protrusion extending downward from the base portion at the second end of the mount support arm at the desired angle to the mount support arm, the first protrusion and second protrusion respectively disposed at substantially opposing ends of the base portion of the surface mount.

5. The mount of claim 1, further comprising a surface fastening component operably engaged with the base portion and configured to be selectably disposed between a mounting position and a stowed position, wherein the surface fastening component is further configured to selectably, mechanically engage with the target mounting surface when disposed in the mounting position.

6. The mount of claim 5, wherein the surface fastening component is configured to mechanically fasten to the target mounting surface such that a face of the base portion engages a first side of the target mounting surface.

7. The mount of claim 6, wherein the first protrusion is configured to engage with the first side of the target mounting surface to provide support in combination with the surface fastening component.

8. The mount of claim 5, wherein the base portion comprises a stowage area configured to store the surface fastening component in the stowed position.

9. The mount of claim 5, wherein the surface fastening component is operably coupled with an adjustment component configured to selectably secure the surface fastening component in the stowed position and to selectably secure the surface fastening component in the mounting position.

10. A mount for selectably mounting a light on a target surface, comprising:

a mount support arm extending between a first end and a second end of the mount and configured to support at least a portion of the weight of a combination of a light mounting base coupled, at the first end, with the mount support arm with a work light engaged to the light mounting base;

a surface fastening component engaged with a base portion at the second end of the mount support arm and configured to be selectably disposed between a mounting position and a stowed position, wherein the surface fastening component is further configured to selectably, mechanically engage with the target surface in the mounting position; and a first protrusion extending downward from the base portion at the second end at a desired angle to the mount support arm and parallel to a first side of the target surface to provide support for the mount.

11. The mount of claim 10, wherein the surface fastening component further comprises a pin configured to be driven into the target surface and provide at least partial support for the combination of the light mounting base, the mount support arm, and the work light.

12. The mount of claim 11, wherein the pin is configured to be disposed at a downward angle relative to the base portion when in the mounting position and to rotate into the stowed position from the mounting position.

13. The mount of claim 11, wherein the pin is selectably replaceable in the base portion.

14. The mount of claim 10, wherein the base portion comprises a stowage area configured to store the surface fastening component in the stowed position.

15. The mount of claim 10, wherein the surface fastening component is operably coupled with an adjustment component configured to selectably secure the surface fastening component in the stowed position and to selectably secure the surface fastening component in the mounting position.

16. The mount of claim 10, wherein the mount is further configured to engage with a second side of the target surface and provide support to the combination of the mount, light mounting base, and the work light when the light mounting base is engaged with the first side of the target surface.

17. The mount of claim 10, further comprising a second protrusion extending downward from the base portion at the desired angle to the mount support arm, the first protrusion and second protrusion respectively disposed apart at opposing ends of the base portion.

18. A light mounting system, comprising:

a surface mounting component configured to provide for selectably mounting a light to a substantially vertical surface, comprising:

a coupler disposed at a first end of the surface mounting component and configured to couple with an angled portion of a light holder base;

a base portion disposed at a second end of the surface mounting component;

at least one protrusion extending downward from the base portion at a desired angle to a mount support arm extending between the first end and the second end of the surface mounting component and configured to engage the substantially vertical surface; and a vertical support pin operably engaged with the base portion, configured to be selectably disposed between a mounting position and a stowed position, and configured to selectably, mechanically engage with the substantially vertical surface when disposed in the mounting position; and the angled portion of the light holder base comprising:

a first end of the angled portion configured to selectably couple with the surface mounting component via the coupler;

a second end of the angled portion configured to selectably engage with the substantially vertical surface when at least one of the at least one protrusion or the vertical support pin is engaged with the substantially vertical surface; and a light mount portion disposed adjacent to a central angled portion and configured to selectably engage with a work light.

19. The system of claim 18, wherein, when disposed in a hanging position from the substantially vertical surface, the system is at least partially supported by one of:

a combination of: the vertical support pin driven into the vertical surface, the second end of the surface mounting component engaged with a first side of the vertical surface, and the at least one protrusion engaged with the first side of the vertical surface; and a combination of: the at least one protrusion engaged with a second side of the vertical surface, and the second end of the angled portion engaged with the first side of the vertical surface.

* * * * *